United States Patent [19]

Kornely, Jr. et al.

[11] Patent Number: 5,021,741

[45] Date of Patent: Jun. 4, 1991

[54] CAST CHARGED PARTICLE DRIFT TUBE

[75] Inventors: Michael G. Kornely, Jr., Centerport; Douglas Holmes, Shirley; Robert G. Micich, Bethpage, all of N.Y.

[73] Assignee: Grumman Aerospace Corporation, Bethpage, N.Y.

[21] Appl. No.: 507,768

[22] Filed: Apr. 12, 1990

[51] Int. Cl.[5] ..... H01J 7/24; H01J 61/52

[52] U.S. Cl. ..... 328/227; 165/169; 313/24; 328/233

[58] Field of Search ..... 313/30, 39, 22, 24, 313/44, 32, 36; 315/5.41, 3.5; 328/227, 233

[56] References Cited

U.S. PATENT DOCUMENTS 3,317,780 5/1967 Ayers ..... 315/3.5

3,449,618 6/1969 Gallagher ..... 313/5.41

3,991,822 11/1976 Morris ..... 165/140

*Primary Examiner*—Leo H. Boudreau

*Assistant Examiner*—Steven P. Klocinski

*Attorney, Agent, or Firm*—Pollock, VandeSande & Priddy

[57] ABSTRACT

A linear accelerator drift tube is formed by a casting technique. Coolant circualting grooves are integrally formed in the central body of the drift tube as well as face plates. This minimizes the temperature of the drift tube in an operating environment thereby maximizing the R.F. efficiency of the unit. The face plates are attached to the central body of the drift tube by means of a solder/electroform joining. The stem of the drift tube includes concentric passages integrally formed in the cast central body which enables efficient circulation of coolant through the drift tube.

8 Claims, 2 Drawing Sheets

CAST CHARGED PARTICLE DRIFT TUBE

RELATED APPLICATIONS

This invention relates to the technology of co-pending U.S. patent application Ser. No. 522,825, filed May 14, 1990 and co-pending U.S. patent application Ser. No. 518,441, filed May 3, 1990, both in the name of the same inventor and assigned to the same assignee.

FIELD OF THE INVENTION

The present invention relates to linear accelerators for charged particle beams, and more particularly to drift tubes employed in connection therewith.

BACKGROUND OF THE INVENTION

Linear accelerators, or Linacs, are devices which use radio frequency energy to accelerate charged particles. In such devices charged particles from a source are passed through a series of drift tubes which are separated from one another by gaps. A potential difference across the gaps, supplied by the radio frequency energy, is used to accelerate the particles.

FIG. 1 indicates a basic prior art linear accelerator system wherein charged particles are generated from an ion source injector 10. Injected charged particles enter the accelerator section of a linear accelerator 12 for the purpose of greatly increasing the velocity of the charged particles. The linear accelerator 12 often includes a hollow cylindrical structure known as a drift tube tank 13. The axis of the drift tube tank 13 is co-linear with the injected beam of charged particles.

A number of drift tubes 18 are arranged in the tank 13, the drift tube body being coaxial with the tank axis. The phase of the radio frequency voltage within the tank provided by the R.F. source 14 and feed 16 is such that the particles are accelerated toward the tank exit 22. Each time particles are accelerated across a gap existing between adjacent drift tube bodies, they momentarily enter a successively positioned drift tube, where they become sheltered from the effects of reversals of the oscillating R.F. voltage. As the particles emerge from each of the drift tubes, the phase of the radio frequency voltage is such as to accelerate the particles toward the next succeeding drift tube. This process is repeated again between drift tubes to achieve the desired particle energy. It should be noted that the lengths of the drift tube bodies increase as necessary to compensate for the increasing velocity of the particles so that the time required for the particles to travel between adjacent drift tubes is always one period of the RF voltage. The finally accelerated charged particles exit the linear accelerator 12 at 22 and become directed at a target 24.

Because of interaction the accelerating charged particles heat the drift tubes 18, it is necessary to introduce coolant into the drift tubes. This is achieved by the stems being hollowed so that coolant may be provided by pipes 25 connected to a coolant reservoir 23.

In the prior art means were provided to initially accelerate the charged particles so that they would enter the linear accelerator at the designed injection velocity. Typically, an accelerator of known type, such as a Cockcrost-Walton, was used as a pre-accelerator. However, understanding of the present invention does not require a description of prior art pre-accelerators, except to note that such pre-accelerators were expensive and complicated. Buncher means to bunch the particles so that they would enter the linear accelerator at proper phase of the RF voltage were also known in the prior art. It should be noted that linear accelerators are provided with a vacuum system for maintaining the vacuum necessary for the acceleration of the charged particle beam.

Although FIG. 1 illustrates a simplified linear accelerator as including only three drift tubes, it should be understood that a large number of such drift tubes are necessary. In the prior art, grooves were machined in tube components to serve as coolant conduits within a drift tube. Inlet and outlet ports were also machined in each drift tube to permit the circulation of coolant flow through the drift tube. Individual components forming a drift tube were then brazed or welded together to form a completed unit. The great disadvantage resides in the high cost involved in machining and brazing operations. Further, an inherent disadvantage exists when individual components of a drift tube are brazed together. This is due to the fact that a number of interfaces are formed, each of which represents a potential point of coolant leakage.

BRIEF DESCRIPTION OF THE PRESENT INVENTION

The present invention presents a drift tube construction which is superior to those of the prior art. The drift tube construction of the present invention includes a central ring-like member fabricated by the lost wax investment casting method wherein coolant grooves are integrally formed within the member. An electroformed ring layer is deposited over the groove so that the grooves become sealed. Face plates are likewise cast which also include electroformed coolant groove covers thereon. The face plates are secured to the central ring-like member by electron beam welding, brazing, or in a preferred embodiment of the invention, solder-/electroform joining.

By casting the face plates of the drift tube with integrally formed grooves, it is possible to increase the coolant capacity of the drift tube as compared with the prior art which did not include coolant conducting grooves in the face plates.

By virtue of the present invention, a more economical means is provided for manufacturing drift tubes in some quantity. Further, the cast drift tubes of the present invention are more reliable in that they minimize the likelihood of coolant leakage. A formation of integrally formed coolant grooves in the face plates also provide an advantage over the prior art designs which did not do so and thereby restricted the cooling capacity of the drift tube.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
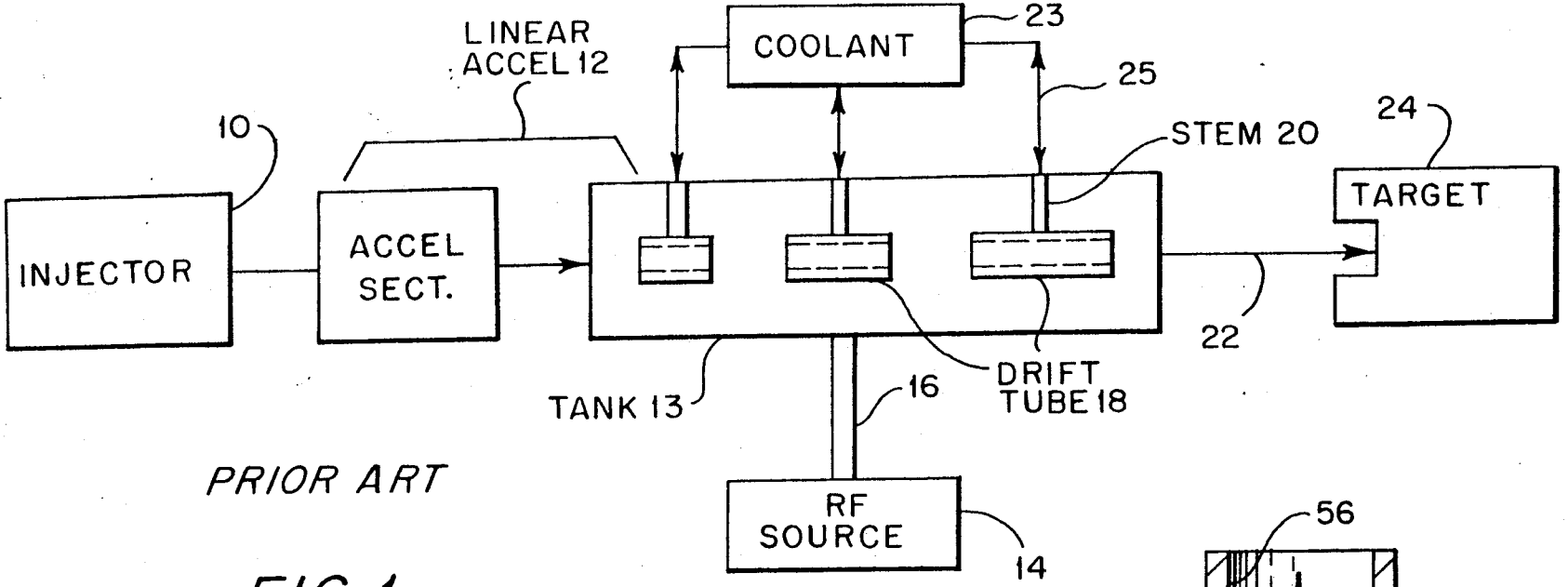
PRIOR ART FIG. 1
FIG. 1 is a simplified diagrammatic illustration of a prior art linear accelerator system.
Figure 2:
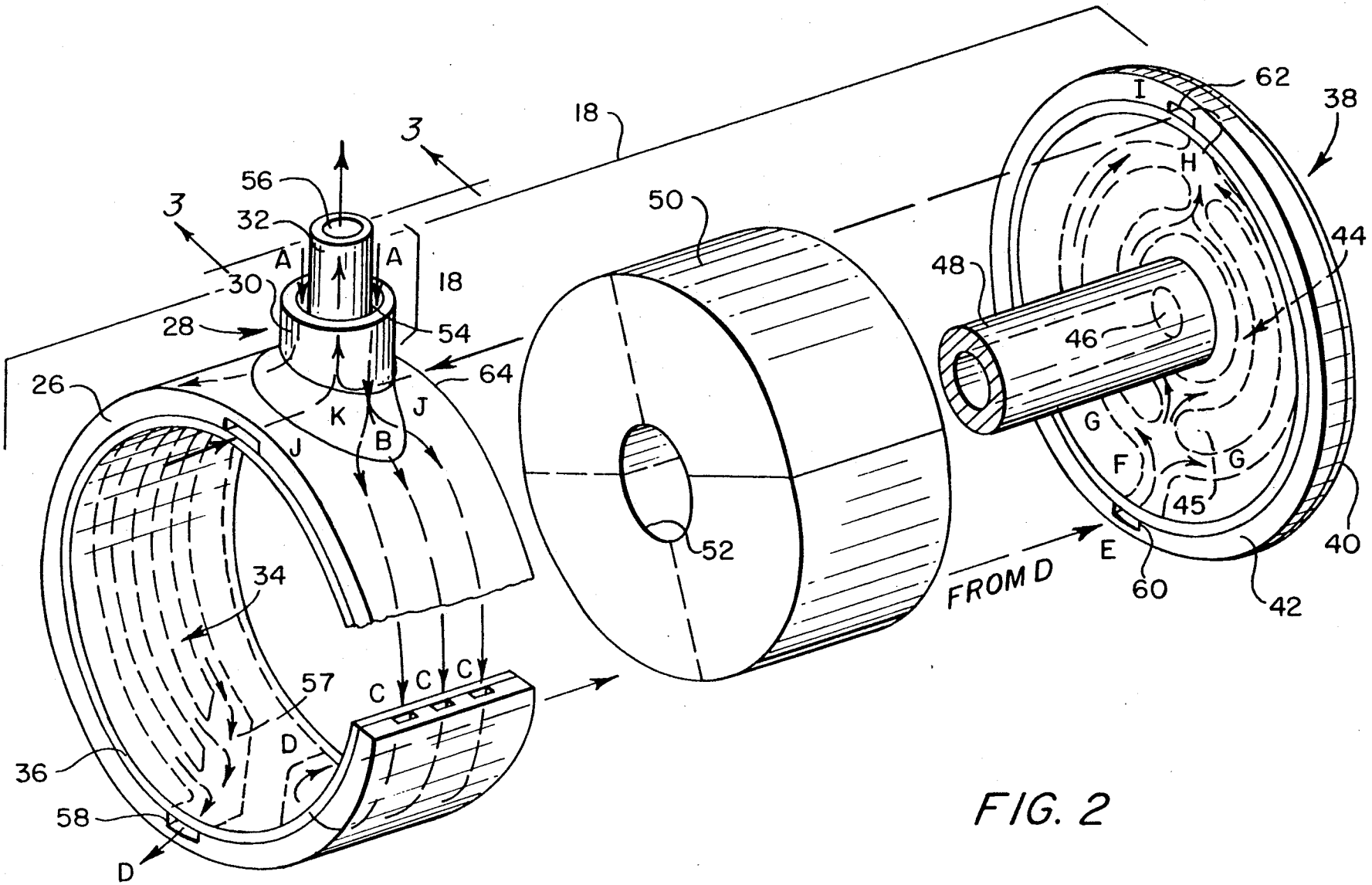
FIG. 2 is a disassembled view of a drift tube in accordance with the present invention.

FIG. 2 is a disassembled view of the drift tube 18 in accordance with the present invention. It is seen to include a central hollowed cylindrical drift tube body 26 which is formed by casting. The material is conductive, preferably copper. A diverter section 28 extends radially outwardly from the body 26 and is formed as part of the casting. The diverter section includes an outer sleeve section 30 and an inwardly coaxially spaced coolant tube 32. The concentric coolant tube and sleeve section extend outwardly for attachment to the inner surface of a linear accelerator tank 13 (FIG. 1). Coolant tube 32 and sleeve section 30 not only serve to supply and return coolant, but they also jointly serve as a stem 20 (FIG. 1) for the drift tube.

A number of parallel grooves 34 are cast into the body 26 and provide channels for circulating coolant. To cover the grooves 34 and thereby seal them, an electroform layer 36 is deposited on the inner surface of body 26.

The transverse open ends of the cylinder body 26 are both covered by individual conductive face plates generally indicated by reference numeral 38 and preferably made of copper. In order to simplify the figures, only one of the face plates is illustrated. The face plate has a smooth contoured circular surface 40 bounded by a circular flange 42 which rests against a corresponding transverse end of drift tube body 26. A series of semi-arcuate grooves 44 are cast into the interior surface of face plate 38 to serve as coolant conduits through the face plate. An electroform layer 45 is formed over the grooves 44 in a manner similar to that of electroformed layer 36, in connection with groove 34.

In the center of face plate 38 is an opening 46. The charged particle beam passing through the linear accelerator is coaxially concentrated so as to flow through the opening 46 in each drift tube face plate. A bore tube 48 is connected between both drift tube face plate, each end of the bore tube being secured to the inner surface of each face plate, around the opening 46. The bore tube may be attached by appropriate means including brazing, welding, or solder/electroform. The bore tube not only serves to concentrate the charged particle beam therein but also restrains the centers of the face plates from thermally induced deflection. Such restraint is important so that the exact dimensions and geometry of the drift tube remain intact during heated operation so as to minimize the likelihood of arcing between adjacent drift tubes. This is due to the fact that minor increases in the gap length between adjacently situated face plates might cause the generation of a sufficiently large breakdown voltage between adjacently situated face plates of two adjacently positioned drift tubes, so as to cause arcing.

The permanent magnet quadrupole 50 is supported within the drift tube. The magnet 50 is cylindrical in shape and has an outer diameter equal to the inner diameter of the electroform layer 36 and is typically segmented. An inner bore 52 has a diameter slightly larger than the outer diameter of bore tube 48 so that the cylindrical magnet 50 can be positioned over the bore tube. The length of the magnet 50 is slightly less than the actual length of the drift tube between confronting surfaces of face plates 38. Magnet 50 is a quadrupole permanent magnet, preferably utilizing rare-earth cobalt materials. As has long been recognized by the prior art, for example U.S. Pat. No. 4,355,236 to Holsinger and issued Oct. 19, 1982, these types of magnets are useful for focussing charged particle beams. In a preferred embodiment of the present invention, a quadrupole samarium-cobalt permanent magnet, is used as disclosed in co-pending application Ser. No. 522,825, filed on May 14, 1990, assigned to a common assignee.

Figure 3:
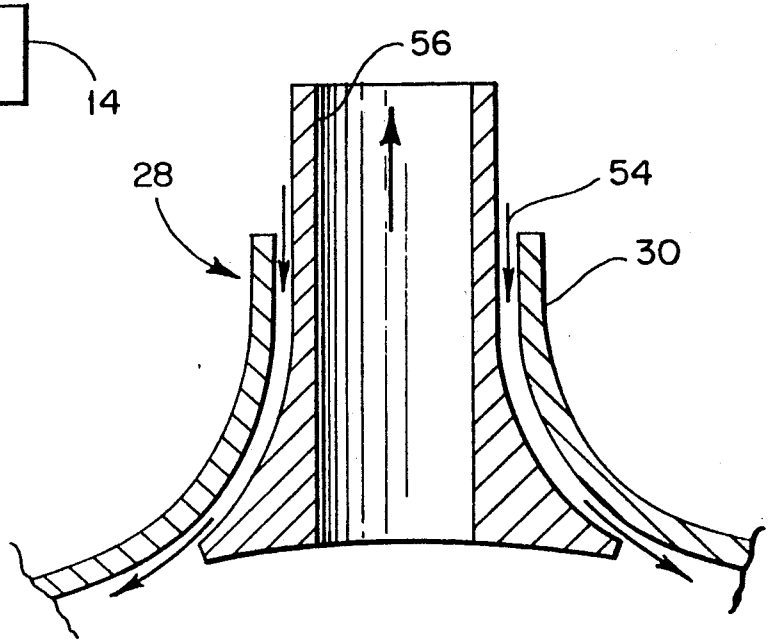
FIG. 3 is a partial sectional view taken along section line 3—3 of FIG. 2 and which illustrates the diverter section of the drift tube for providing inlet and outlet for coolant to the drift tube.

Now considering the coolant circulation through the drift tube, attention is directed to the sleeve section 30 and coolant tube 32 coaxially dimensioned in a manner to retain a cylindrical passage 54 therebetween. The passage is also shown in cross section in FIG. 3. The center of coolant tube 32 provides a tubular passage for coolant as well. The passages 54 and 56 provide means for inletting and outletting coolant for proper circulation. The direction of flow may be into passage 54 and out from passage 56 or the reverse. It will be noted from FIGS. 2 and 3 that the diverter section 28 is smoothly contoured so as to avoid sharp corners that would cause undesirable pressure drops in coolant flow.

Assuming inlet coolant flow through passage 54, one can trace the flow of coolant through the grooves 34 formed in body 26. Thus, the passage 54 is seen to initiate flow through the body of the diverter tube at point A. At the base of the diverter section, the grooves diverge at point B. Three parallel grooves are shown to guide coolant flow past points C, although a greater or lesser number of grooves can be employed. At point D, the individual grooves become combined for exit through a port which communicates with a mating inlet port 60 formed in face plate 38. As will be appreciated from viewing FIG. 2, there are two sets of parallel grooves formed in body 26. The first set of grooves will terminate at an outlet port on the right illustrated transverse end of body 26 while the second set of parallel grooves terminates in a common channel 57 which in turn terminates at outlet port 58 on the left body end. Of course, outlet port 58 will also communicate with an inlet port of an adjacently situated face plate (not shown).

Considering the flow through the face plate, reference is continued to FIG. 2. Inlet port 60 at the illustrated face plate 38 receives the continued flow of coolant at point E. From that point, the coolant again diverges into two parallel circular paths, each path including points G and H as illustrated in the figure. The grooves converge at point H for exit at outlet port I formed in flange 42 of the face plate 38. The outlet port 62 communicates with an inlet port 64 in the body 26 of the drift tube and defines a continuation of the coolant flow at point J. After point J the coolant is directed to the passage 56 in coolant tube 32 for exiting to the coolant reservoir 23 (FIG. 1) thereby completing a coolant cycle through the drift tube, including the face plates. Cryogenic cooling is often preferred to maximize RF efficiency.

In constructing the drift tube shown in FIG. 2, the face plates 38 may be secured to the ends of drift tube body 26 by means of electron beam welding, brazing, or in a preferred embodiment of the present invention, by means of solder/electroform joining. The latter-mentioned method is disclosed in co-pending application Ser. No. 518,441, filed on May 3, 1990, assigned to the assignee of the present application. The bore tube 48 may be attached to the inside central portions of the face plates 38 by joining means as just mentioned.

The utilization of solder/electroform joining is preferable for the present invention because the intended rare earth cobalt quadrupole magnet 50 should not be exposed to temperatures above 100° C. if maximum permanent quadrupole magnetism is to be assured. Low utilization temperatures for solder/electroform joining ensure operating temperatures near this value for relatively short melting times. However, other techniques for joining drift tube components may be employed where assembly can be carefully controlled so as to minimize the likelihood of destructive temperature influences on the quadrupole magnet.

As thus described, the present invention offers a drift tube structure having cast components which lead to reduced manufacturing costs while assuring close dimensional tolerances. The present drift tube construction enables coolant circulation throughout the entire drift tube structure, including the face plates, so that heat build-up is minimized and R.F. efficiency maximized.

It should be understood that the invention is not limited to the exact details of construction shown and described herein for obvious modifications will occur to persons skilled in the art.

We claim:

1. A drift tube housing comprising:

a cast hollowed cylindrical body of electrical conductive material;

grooves cast in the body interior surface;

a layer formed over the grooves thus forming coolant passages through the body;

cast electrical conductive face plates closing open ends of the body;

grooves cast in the face plate interior surfaces;

a layer formed over the grooves in each face plate thus forming coolant passages through the face plates;

ports formed in the body for connecting the coolant passages of the body and the face plates; and a concentric cast tube integrally formed with the body for producing two internal concentric coolant passages communicating with the body coolant passages thus providing coolant supply and return for the drift tube while simultaneously serving as a support stem.

2. The structure set forth in claim 1 wherein the concentric tube terminates in a smoothly contoured diverter section integral with the body and having internal passages respectively channeling circulating flow between the tube and the coolant passages in the body.

3. The structure set forth in claim 1 wherein the layers formed over the grooves in the body and face plates are electroformed layers.

4. The structure set forth in claim 1 together with coaxially located apertures formed in the face plates; and a bore tube extending between the apertures and secured at opposite ends thereof to the face plates for directing a charged beam therethrough.

5. A drift tube comprising:

a cast hollowed cylindrical body of electrical conductive material;

grooves cast in the body interior surface;

an electroformed layer formed over the grooves thus forming coolant passages through the body;

cast electrical conductive face plates closing open ends of the body;

grooves cast in the face plate interior surfaces;

an electroformed layer formed over the grooves in each face plate thus forming coolant passages through the face plates;

ports formed in the body for connecting the passages of the body and the face plates;

a concentric cast tube integrally formed with the body for producing two internal concentric coolant passages communicating with the body coolant passages thus providing coolant supply and return for the drift tube while simultaneously serving as a support stem;

the concentric tube terminating in a smoothly contoured diverter section integral with the body and having internal passages respectively channeling circulating flow between the tube and the coolant passages in the body; and a hollowed cylindrical quadrupole permanent magnet positioned in the body and having an outer diameter substantially equal to the inner diameter of the body electroform layer.

6. The structure set forth in claim 5 together with coaxially located apertures formed in the face plates; and a bore tube extending between the apertures and secured at opposite ends thereof to the face plates, the bore tube centrally supporting the magnet and directing a charged beam axially therethrough.

7. The structure set forth in claim 6 wherein the grooves in the body are two sets of generally semicircular complementary grooves.

8. The structure set forth in claim 6 wherein the grooves in the face plates are two sets of generally semicircular complementary tubes.

* * * * *